US007553080B2

(12) United States Patent
Grady

(10) Patent No.: US 7,553,080 B2
(45) Date of Patent: Jun. 30, 2009

(54) GROUNDED ROTATING ANODE X-RAY TUBE HOUSING

(76) Inventor: John K. Grady, 43 Slough Rd., Harvard, MA (US) 01451

( * ) Notice: Subject to any disclaimer, the term of this patent is extended or adjusted under 35 U.S.C. 154(b) by 62 days.

(21) Appl. No.: 11/672,083

(22) Filed: Feb. 7, 2007

(65) Prior Publication Data

US 2008/0187106 A1 Aug. 7, 2008

(51) Int. Cl.
*H05G 1/06* (2006.01)

(52) U.S. Cl. ..... 378/194; 378/121

(58) Field of Classification Search ..... 378/136, 378/194, 121
See application file for complete search history.

(56) References Cited

U.S. PATENT DOCUMENTS

| | | | | |
|---|---|---|---|---|
| 2,320,559 | A * | 6/1943 | Bouwers | 378/203 |
| 3,094,616 | A * | 6/1963 | Palermo, Jr. et al. | 378/179 |
| 5,091,929 | A | 2/1992 | Grady | |
| 6,362,415 | B1 | 3/2002 | Snyder et al. | |
| 6,922,463 | B2 | 7/2005 | Tang et al. | |
| 2005/0100659 | A1 | 5/2005 | Chidester | |

FOREIGN PATENT DOCUMENTS

WO WO 2004/013883 2/2004

OTHER PUBLICATIONS

Varian Medical Systems, Inc., "G-1092/G-1094: Rotating Anode X-Ray Tube", 4525, Rev. D, Sep. 2005, Salt Lake City, Utah, USA.
Parker Medical, Inc., "Extended Federal Standard High Voltage Cables and Receptacles", Nov. 2002, Bridgewater, Connecticut, USA.
Claymount North America Corporation, "03/04 Federal Standard Cable Assemblies", Jan. 2007, Elmhurst, Illinois, USA.
Claymount North America Corporation, "Federal Standard 03/04 Receptacles", Jan. 2007, Elmhurst, Illinois, USA.

* cited by examiner

*Primary Examiner*—Chih-Cheng G Kao
(74) *Attorney, Agent, or Firm*—Holland & Bonzagni, P.C.; Donald S. Holland, Esq.

(57) ABSTRACT

An improved rotating anode x-ray tube housing is disclosed. In the preferred embodiment: a single cable, insulated with Ethylene-Propylene Rubber ("EPR"), has an extended Federal Standard terminal or plug mounted within an extended Federal Standard receptacle, attached to an anode end of the housing; the cable is designed to carry up to approximately 150 kV to power the cathode; and insulation of the plug also insulates the 150 kV from a grounded center portion of the x-ray tube and the anode disk area. The longitudinal axes of the anode and high-voltage plug are parallel to one another. This new configuration allows the cathode plug and receptacle to be moved virtually entirely inside the housing. This results in absolute minimal size of the assembly, and a single cable that exits parallel to the rotational axis of the housing.

14 Claims, 5 Drawing Sheets

GROUNDED ROTATING ANODE X-RAY TUBE HOUSING

FIELD OF INVENTION

The present invention relates in general to medical x-ray tubes. More particularly, it relates to rotating anode x-ray tube housings carrying high voltage ("HV").

BACKGROUND

Most x-ray generating devices operate in similar fashion. X-rays are produced in a vacuum tube housing or "tube" where electrons are emitted, accelerated, and then deposited upon a material of a particular composition. This process takes place, for example, within a grounded rotating anode x-ray tube comprising a vacuum, a cathode, and an anode. The cathode, when heated by an electrical current supplied by a high voltage, emits a stream of electrons. Due to an electrical potential difference across the anode and the cathode, the electrons are accelerated and impinge upon the anode, thus producing the x-rays upon impact.

Since the initial clinical use of diagnostic, general purpose medical x-ray tubes, the high voltage applied to the tube housing generally has been applied equally to each end of the tube. This "bipolar" design excludes low voltage tubes such as mammography and x-ray diffraction tubes, which generally operate at 50 kV or less.

A bipolar, two HV cable, design has become accepted to reduce the insulation requirements to ground by one half. The total voltages applied to x-ray tubes can be very high, e.g., 150 kV. It was much easier, especially in the beginning, to insulate for 75 kV positive and 75 kV negative, on opposite ends of the x-ray tube, rather than 150 kV on just one end. End-grounded x-ray tubes themselves have certain known advantages, especially cooling, and reduced off focus radiation when metal enclosed, but the x-ray tube itself is not the subject of this application.

This bipolar voltage design was first used with so-called "aerial" systems (i.e., exposed high voltage) and carried on with later "shockproof cable" systems, as cable insulation in the latter was generally natural rubber and very difficult to manufacture for 150 kV with adequate flexibility.

The continuing requirement for two cables, when used with a lead-shielded rotating anode x-ray tube, led to a generally round or pipe shaped x-ray tube enclosure for use with the oil filled "shock proof" system. The HV cable ports were placed tangentially to the circular dimension at either end, and therefore at an approximate 90° angle to the longitudinal or rotational axis of the x-ray tube (hereinafter "tube axis"). See Applicant's FIGS. 1A, 1B, 1C. This is the usual design today.

This mechanical configuration is of no consequence when the tube is mounted "overhead" on a telescoping tube or in an x-ray fluoroscopy table. It gives a reasonably compact unit, and cables leaving the tube at 90° to the longitudinal axis are acceptable.

However, attempts to improve this packaging aspect in situations where the cables caused external mechanical interference were tried, in particular, by Picker X-Ray in the 1950's. Picker's configuration (see FIGS. 2A, 2B, 2C, 2D) had the high voltage cable housings or cable ports take a 90° turn, while the plugs were disposed in opposite directions parallel to the main housing. The center portion remained as described previously (i.e., a pipe shape). This provided a minimal improvement and was shortly abandoned. Nonetheless, it shows an attempt to solve the spatial problems of conventional cable exits 90° to the tube axis. That problematic conventional cabling can interfere with optimal equipment configuration or "packaging" of the tube housings and cable exit ports in compact equipment, especially on C-arm x-ray machines ("C-arms").

Picker, and the former Machlett Laboratories (an x-ray tube unit of Raytheon), had also experimented in the 1930's-1940's with a bipolar tube housing where the two cable sockets were placed side-by-side generally behind the rotational axis of the x-ray tube's anode (hereinafter "anode rotation axis"). The "front" of the tube was the exit point where the beam came out through a window. (See the "Dynamax Fluoro Tube" illustrated in FIGS. 3A, 3B, 3C, 3D.) This configuration had the disadvantage of increasing the housing dimension to the back, as measured along an extension of the x-ray beam axis.

Such an increase poses a major problem for a modern application to a C-arm x-ray machine: the back of the tube would hit the floor that much sooner, as the overall object is to maximize the distance between a patient on a table and an x-ray focal spot, with the x-ray source underneath the table. If the plugs were moved to the sides, to be in the plane of the center of the x-ray tube (i.e., an obvious design change), the width of the housing would become excessive, and the housing would begin to look again like FIGS. 2A-2D. The large housing would strike external objects sooner than a plain cylinder or pipe shape, especially when the whole assembly was tilted in either axis in clinical use.

Accordingly, it is a primary object of this invention to reduce the overall size of the rotating anode x-ray tube housing to avoid the housing striking external objects.

It is another primary object to provide a smaller x-ray tube housing that is ideal for use in a C-arm x-ray machine, where the x-ray tube is an extension of the C-arm without projections from the side.

It is a more specific object to provide an x-ray tube housing, commensurate with the above-listed objects, which also allows the known advantages of end grounded rotating anode tubes to be implemented on C-arms or on overhead x-ray telescopes, while eliminating one high voltage cable.

It is yet another specific object to provide an x-ray tube housing, commensurate with the above-listed objects, that is simple in design yet more reliable in use.

SUMMARY OF INVENTION

An improved rotating anode x-ray tube housing is disclosed. In the preferred embodiment: a single cathode cable, insulated with Ethylene-Propylene Rubber ("EPR"), has an end portion with an extended Federal Standard terminal or plug; the plug is mounted axially into an extended Federal Standard receptacle at the anode end of the housing; the cable is designed to carry approximately 150 kV to power the cathode; and the insulation of the plug also insulates the 150 kV from the generally grounded center portion of the x-ray tube, and as it passes the anode edge. The anode is at ground potential.

This new configuration allows the cathode plug to be moved virtually totally inside the housing. The cathode plug can physically almost touch the center section of the x-ray tube (i.e., which can be glass or, preferably, metal). This results in a minimal size of the assembly and a single cable that exits parallel to the long axis.

The invention also eliminates the rather difficult to achieve 75 kV insulation now required in bipolar designs between the anode motor coil and metal center (which are both essentially grounded) and the anode terminal which is at 75 kV in present designs. This is a source of failure and poor reliability that is eliminated; no insulation is needed in the new configuration, which simplifies the tube design a great deal.

Prior rotating x-ray tubes have used two rubber-coated cables, each capable of handling up to 75 kV, connected tangentially at the anode and cathode ends of the tubes, one at each end. That prevented stiffness problems with the prior rubber coating needed for handling 150 kV. New advanced cable insulation technology (i.e., EPR) allows for a single cable, instead of the two bulky ones, where the single cable can now carry 150 kV and remain flexible.

BRIEF DESCRIPTION OF DRAWINGS

The above and other objects will become more readily apparent when the following description is read in conjunction with the accompanying drawings, in which.

DESCRIPTION OF INVENTION

Figure 1A:
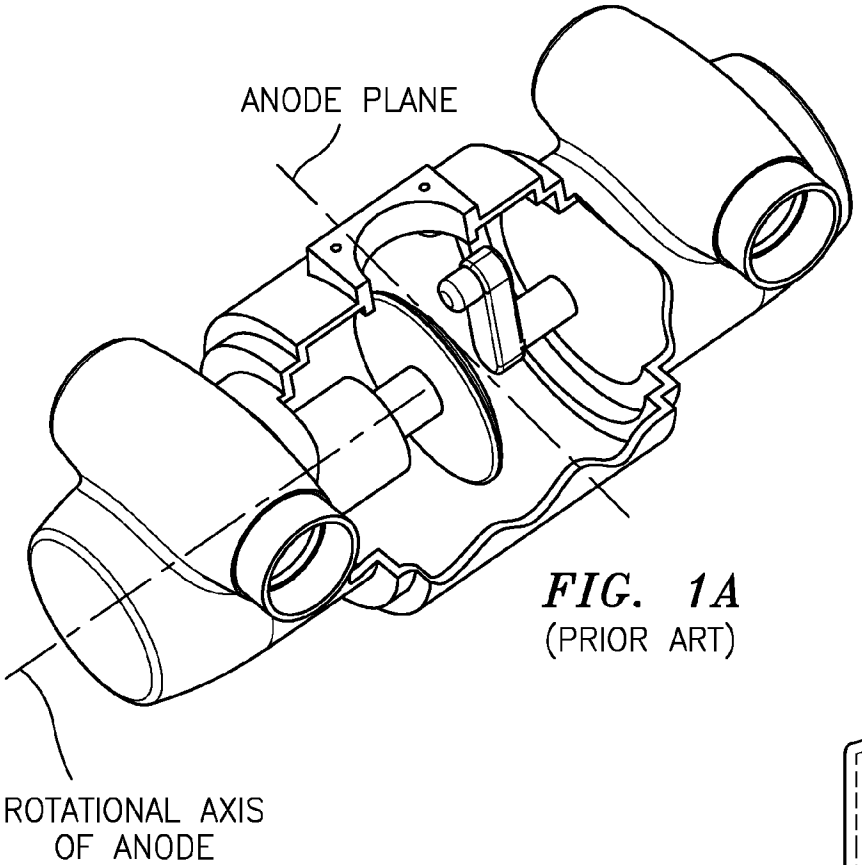
FIG. 1A (PRIOR ART)
FIG. 1A, labeled "Prior Art," illustrates the most common rotating anode x-ray tube housing described in the Background section above. Portions have been broken away to show the interior of the housing.
Figure 1B:
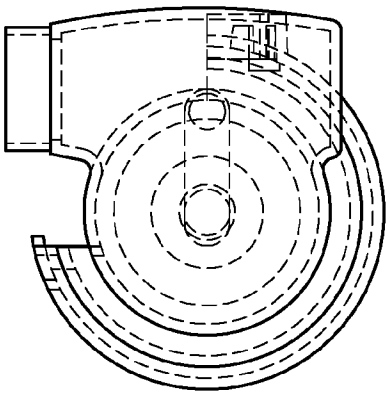
FIG. 1B (PRIOR ART)
FIG. 1B, labeled "Prior Art," illustrates a right-end plan view of FIG. 1A.
Figure 1C:
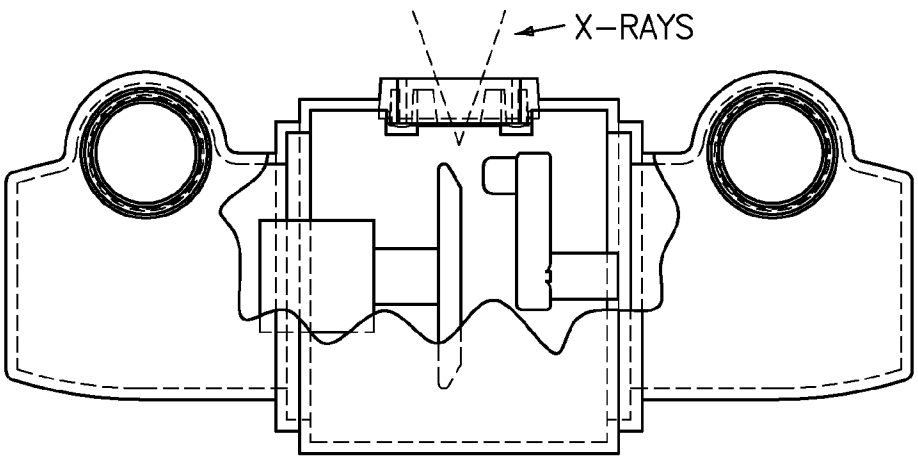
FIG. 1C (PRIOR ART)
FIG. 1C, labeled "Prior Art," illustrates a top plan view of FIG. 1A. Portions have been broken away to show the interior of the housing.
Figure 2A:
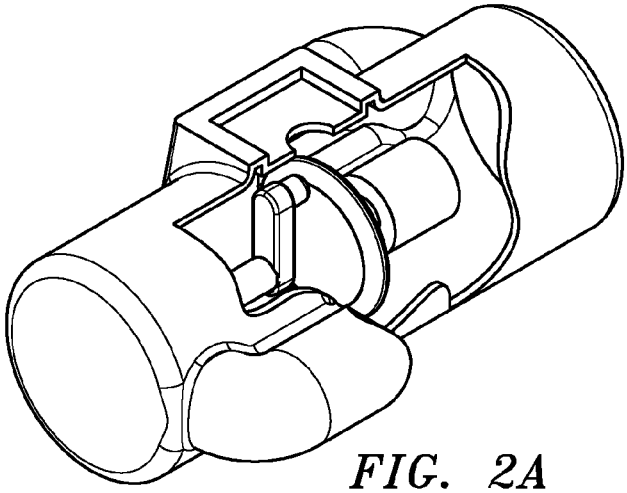
FIG. 2A (PRIOR ART)
FIG. 2A, labeled "Prior Art," illustrates Picker X-Ray's housing described in the Background section. Portions of the housing have been broken away to show its interior.
Figure 2B:
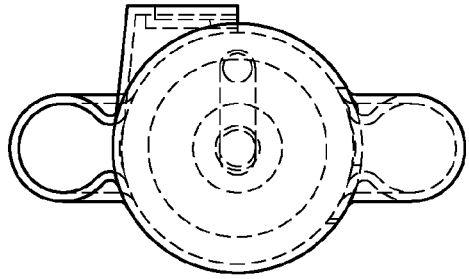
FIG. 2B (PRIOR ART)
FIG. 2B, labeled "Prior Art," illustrates a left-end plan view of FIG. 2A.
Figure 2C:
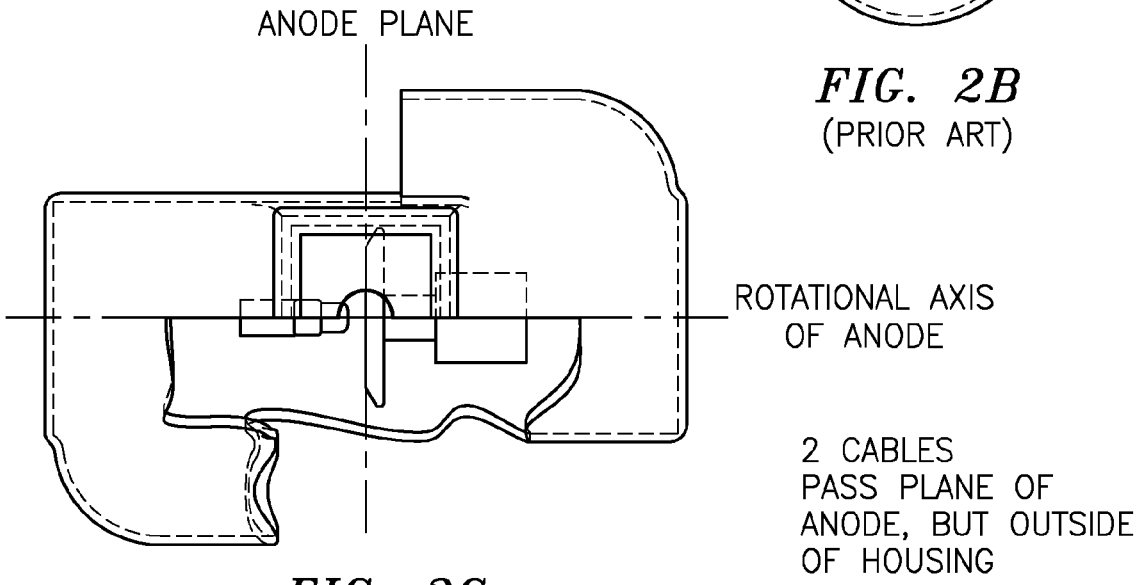
FIG. 2C (PRIOR ART)
FIG. 2C, labeled "Prior Art," illustrates a top plan view of FIG. 2A. Portions have been broken away to show the interior of the housing.
Figure 2D:
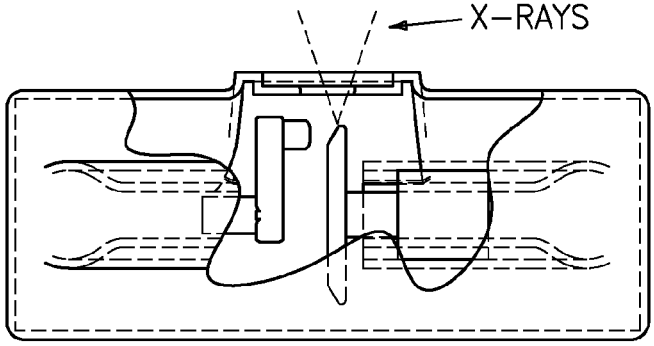
FIG. 2D (PRIOR ART)
FIG. 2D, labeled "Prior Art," illustrates a front plan view of FIG. 2A, with portions broken away.
Figure 3A:
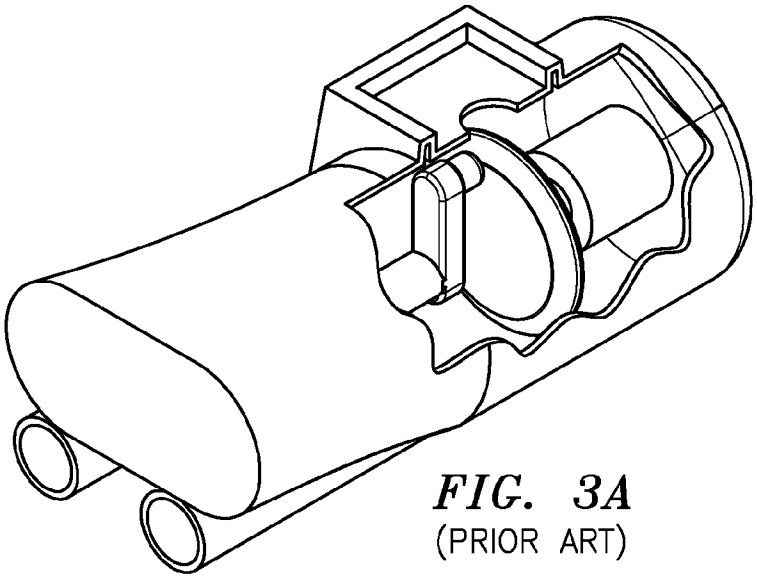
FIG. 3A (PRIOR ART)
FIG. 3A, labeled "Prior Art," illustrates a perspective view of the "Dynamax Fluoro Tube" mentioned in the Background section. Portions have been broken away to show the interior of the housing.
Figure 3B:
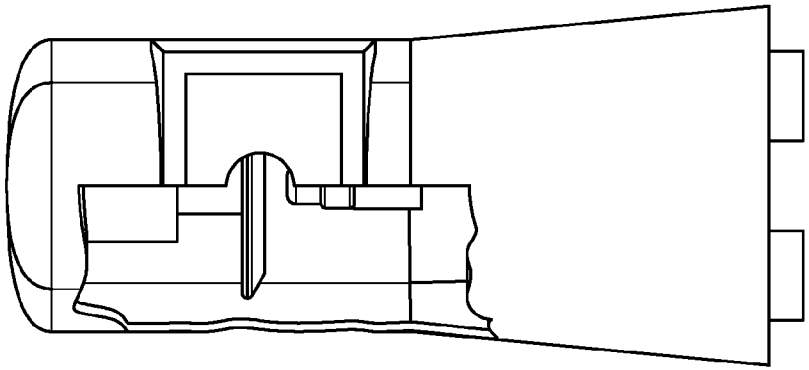
FIG. 3B (PRIOR ART)
FIG. 3B, labeled "Prior Art," illustrates a top plan view of FIG. 3A, with portions broken away.
Figure 3C:
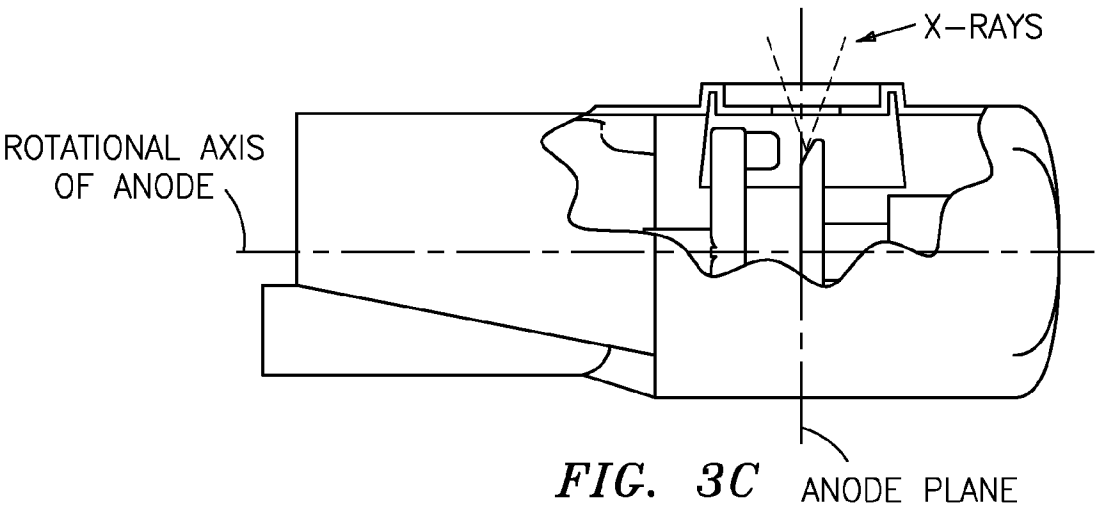
FIG. 3C (PRIOR ART)
FIG. 3C, labeled "Prior Art," illustrates a front plan view of FIG. 3A, with portions broken away.
Figure 3D:
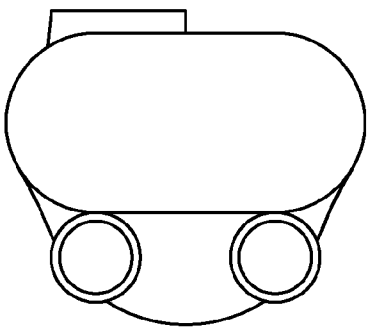
FIG. 3D (PRIOR ART)
FIG. 3D, labeled "Prior Art," illustrates a left-end plan view of FIG. 3A.

Referring to FIGS. 4A, 4B, 4C, 4D and 4E, Applicant's preferred embodiment 100 of a "GROUNDED ROTATING ANODE X-RAY TUBE HOUSING" is shown in detail. Applicant's preferred embodiment is an arrangement of a purchased pre-designed rotating anode x-ray tube but having a unique mechanical arrangement for a high voltage ("HV") cable in a lead-lined housing of specific design/features.

Applicant's preferred tube 100 is a bipolar tube, as all tubes are, with a single-end terminal connection which includes a metal shell or housing 112, preferably aluminum, lined with lead. Housing 112 contains a rotating anode x-ray tube 114 insert (i.e., Model G-1092 manufactured by Varian Medical Systems, Inc.) with a rotating anode disk 116 and an adjacent cathode 118; and, an extended Federal Standard receptacle 120 (rated up to 160 kV), such as the type manufactured by Claymount Assemblies B.V. Both the anode insert 114 and receptacle 120 are mounted on an anode end 122 of the housing. The anode and plug are spaced apart with their longitudinal axes parallel to one another.

Applicant has submitted, as part of its Information Disclosure Statement ("IDS") for this application, a printed publication by Varian Medical Systems, Inc., entitled "G-1092/G-1094 Rotating Anode X-ray Tube" . That publication describes the Varian G-1092 and includes a detailed drawing of the insert 114. Briefly, the Varian G-1092 is a 4.25" (108 mm) 150 kV, 740 kJ (1.0 MHU) maximum anode heat content, rotating anode insert. This metal center section insert is designed for radiography, cineradiography, digital and film screen angiography procedures. The center features a 12° rhenium-tungsten facing on molybdenum with a graphite-backed target or anode disk and is available with different focal spots.

Figure 4A:
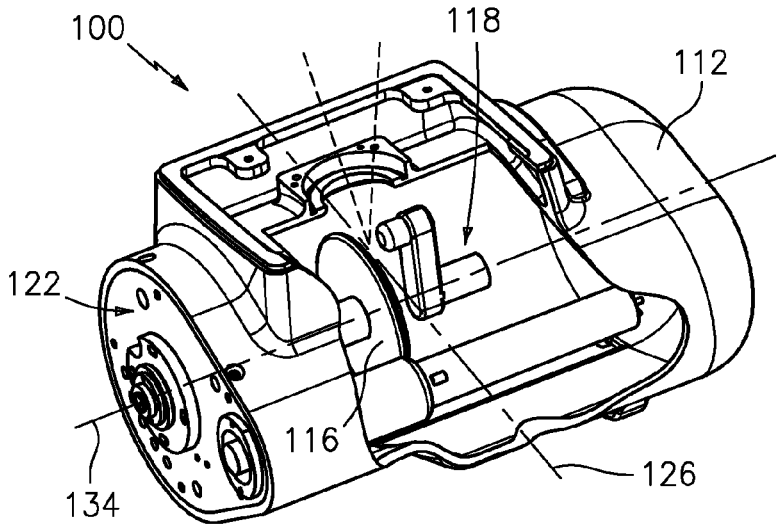
FIG. 4A illustrates a perspective view of a "GROUNDED ROTATING ANODE X-RAY TUBE HOUSING" constructed in accordance with the present invention. Portions have been broken away to show the interior of the housing.
Figure 4B:
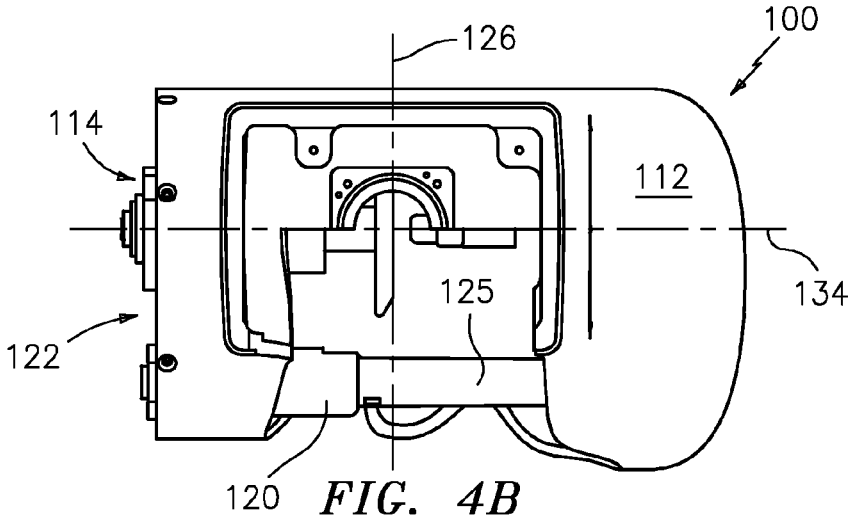
FIG. 4B illustrates a top plan view of FIG. 4A.
Figure 4C:
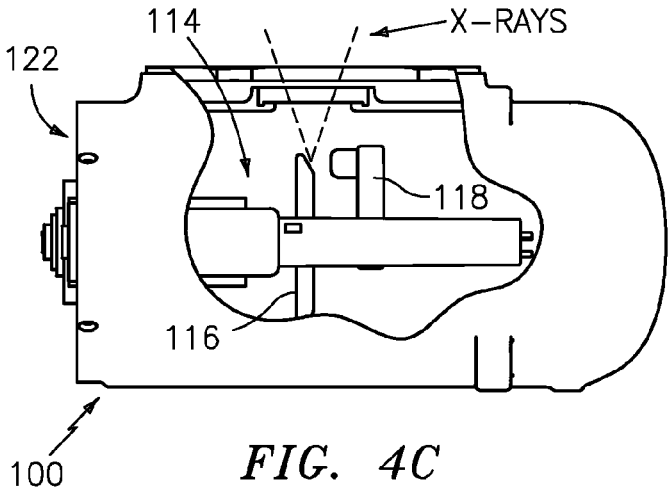
FIG. 4C illustrates a front plan view of FIG. 4A, with portions broken away.
Figure 4D:
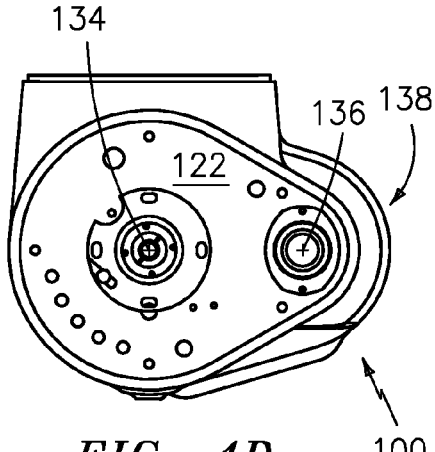
FIG. 4D illustrates a left-end plan view of FIG. 4A.
Figure 4E:
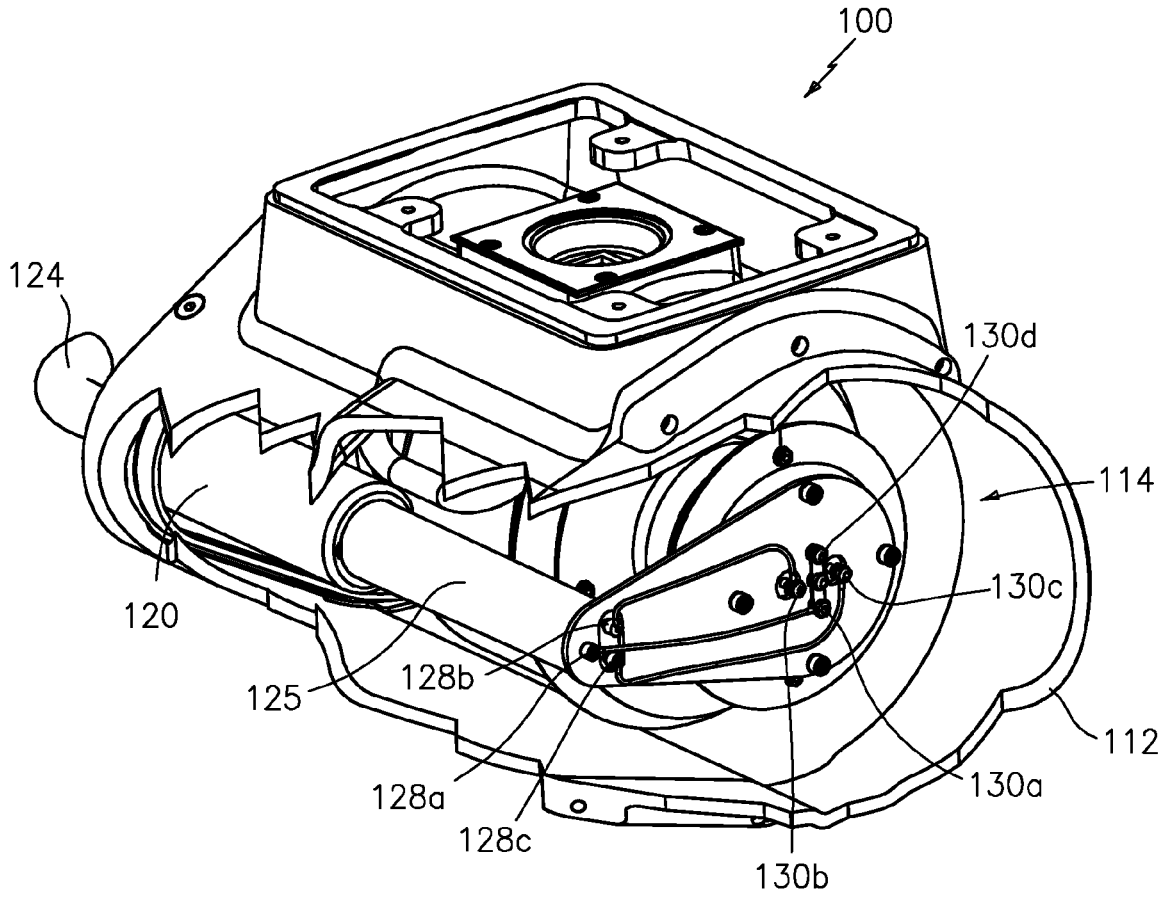
FIG. 4E is a perspective view of the right-hand end of FIG. 4A, with portions broken away.

Referring to FIG. 4E in the present application, a single HV cathode cable 124 (rated to carry up to 150 kV) has an extended Federal Standard terminal end or "cathode" plug 125 which is mounted axially to and within an extended Federal Standard receptacle 120. This cathode cable 124 supplies power to cathode 118.

The terminal end of cable 124 is recessed into a deep well (e.g., receptacle 120) at an anode end 122 of Applicant's housing 112. The terminal end and its associated receptacle 120 are contained virtually or substantially entirely within housing 112. Only an external tip of the terminal end extends beyond the anode end 122, outside the housing 112 (see FIG. 4B).

Even though the cathode cable 124 supplies power to the cathode 118, the insulation of cathode plug 125 also helps insulates the 150 kV from the generally grounded center portion of the x-ray tube 116 and as that plug 125 passes an extended anode plane 126 of the anode disk 114 (see FIG. 4E). The anode 116 is also at ground potential.

This embodiment 100 allows the cathode cable 124 and plug 125 to physically almost touch the center section of the x-ray tube (i.e., which can be glass or, preferably, metal). This minimizes the size of the assembly.

It also results in a single or sole (i.e., only one) cable 124 which exits parallel to the longitudinal axis of the housing 112. The sole cable 124 extends into the housing 112, where it can be exposed to any suitable insulating medium (not shown) such as a gas or, preferably, a high-dielectric purified transformer oil, e.g., SHELL DIALA® Plug 125 also insulates the cable.

Use is made of modern Ethylene-Propylene Rubber ("EPR") as the insulation coating for cathode cable 124. This coating, approximately 0.500 inch thick radially, allows the application of 150 kV to one end 122 of x-ray tube housing 112, yet keeping a reasonable cable size and flexibility for universal application. A thin semiconductor rubber shield is placed over the main insulation in a known manner. This EPR coated cable 124 is especially useful for a C-arm application (not shown).

FIG. 4E illustrates one end of anode tube 114. Insulated, oil resistant (e.g., copper) wires connects end pins 128*a*, 128*b*,

128*c* to cathode terminals 130*a*, 130*b*, 130*c* of x-ray tube 114. That wiring is exposed to the insulating medium.

Pin 130*a* is a common terminal. It is the "bridge" between the power supply (here, cable 124) and the load (here, cathode 118). Pins 130*b*, 130*c* act as traveler terminals, which lead to ends of the cathode 118. The three terminals 130*a*, 130*b*, 130*c* permit a triode switch (not shown) to be used inside the x-ray tube.

Though not shown in the drawings, the other end of tube 114 is essentially at ground by being clamped into the housing structure.

Applicant's preferred embodiment thereby enables use of the metal center rotating anode x-ray tube 114 with its metal center and anode 116 at ground potential. This eliminates the rather difficult to achieve 75 kV insulation now required in bipolar designs between the anode motor coil and metal center (which are both essentially grounded) and the anode terminal which is at 75 kV in present designs. This is a source of failure and poor reliability that is eliminated; no insulation is needed in the new configuration, which simplifies the tube design a great deal.

The resulting housing 112 is no larger than the minimum pipe diameter to enclose the rotating anode x-ray tube 114 when measured along the longitudinal (and rotational) axis 134 of x-ray tube 114, does not have any cables exiting tangentially, and allows neat and totally enclosed mounting of the rotating anode tube assembly 114 to the end of a C-shaped arm or x-ray stand (not shown). Having the cable plug 125 passing inside the housing through the extended anode plane 126 of the rotating anode disk 116, with the plug's longitudinal axis 136 generally parallel to the tube's (longitudinal and) rotational axis 134, but next to it, essentially "hides" the much desired long length of the cable plug 125 by placing it internally, next to the tube walls. This arrangement causes a small bulge at 138 (see FIG. 4D) in the housing 112 outline, but that single bulge can be rotated around the tube axis 134 to best avoid external interferences or collisions.

Applicant's improvement in packaging allows the known advantages of end grounded rotating anode tubes to be implemented on C-arms or on overhead x-ray telescopes, while eliminating one HV cable. Prior to this, end-grounded medical diagnostic tubes for 150 kV, or more, were generally embedded into the structure (e.g., U.S. Pat. No. 5,091,929) without an external cable.

Competitive grounded anode designs tend to use a very short cathode cable plug, at the cathode end of the tube. Those designs can lead to high voltage distribution problems and arcing. See, e.g., the International Publication Number WO 2004/013883 A2, entitled "X-RAY TUBE HIGH VOLTAGE CONNECTOR," published Feb. 12, 2004. That is a PCT application by Varian Medical Systems, Inc.

Some cables in prior x-ray tubes pass the anode rotation axis but, unlike Applicant's design, are outside the housing. See, e.g., FIGS. 2A-2D.

Each "Prior Art" x-ray tube depicted in FIGS. 1A-1D, 2A-2D, 3A-3D, as well as Applicant's x-ray tube depicted in 4A-4E, would normally have a glass or metal bulb. The bulbs have been omitted from the drawings for the sake of clarity.

Note that FIG. 4E shows an unused common pin 130*d* above common pin 130*a*. That unused pin is for a 4-pin Federal Standard cable assembly, and Applicant's preferred embodiment uses only a 3-pin assembly. Applicant's invention could, of course, be used in a 4-pin pin assembly.

It should be understood by those skilled in the art that other obvious structural modifications can be made without departing from the spirit of the invention. For example, the embodiment 100 can be powered by a range of 50 kV to 150 kV. Accordingly, reference should be made primarily to the appended claims rather than the foregoing description to determine the scope of the invention.

I claim:

1. In a rotating anode x-ray tube housing of the type having a cathode and rotating anode, wherein the anode has a disk with both a rotational axis and an extended anode plane, the improvement comprising:

a. the sole cable to the housing being a cathode cable having a cathode plug attached to an end portion of the cable;

b. the plug is mounted within a receptacle attached to the housing; and c. wherein:

i. the plug and receptacle are coaxial;

ii. the receptacle extends into the housing;

iii. the receptacle is contained substantially entirely within the housing;

iv. the cathode plug is contained entirely within the housing; and v. both the anode and cathode plug extend from a same end of the housing and are substantially parallel to but offset from one another.

2. The housing of claim 1 wherein the cable is exposed to an insulating medium within the housing.

3. The housing of claim 2 wherein the insulating medium is transformer oil.

4. The housing of claim 1 wherein only a single cable enters at an anode end of the housing, via the plug and receptacle, wherein the plug and receptacle each has a longitudinal axis parallel to the rotational axis.

5. In a rotating anode x-ray tube housing of the type having a cathode and rotating anode, wherein the anode has a disk with both a rotational axis and an extended anode plane, the improvement comprising:

a. the sole cable to the housing being a voltage cable having a terminal end axially mounted within a receptacle, the receptacle is attached to an anode end of the housing and extends inside the housing, wherein:

i. the terminal end and the receptacle are contained substantially entirely within the housing;

ii. a longitudinal axis of the single terminal end, and a longitudinal axis of the receptacle, are aligned substantially parallel to the rotational axis; and iii. the terminal end passes through the extended anode plane and is connected to the cathode.

6. The housing of claim 5 wherein the terminal end connection is an extended Federal Standard terminal and the receptacle is an extended Federal Standard receptacle.

7. The housing of claim 6 wherein the cable is exposed to an insulating medium within the housing.

8. The housing of claim 7 wherein the insulating medium is transformer oil.

9. The housing of claim 5 wherein a single cable enters at an anode end of the housing, where it is axially mounted by a Federal Standard cable assembly and a longitudinal axis of the cable assembly is parallel to the rotational axis.

10. In a rotating anode x-ray tube housing of the type having a cathode and rotating anode, wherein the anode has a disk with both a rotational axis and an extended anode plane, the improvement comprising:

a. the sole cable to the housing being a cathode cable having an attached Federal Standard plug mounted within a Federal Standard receptacle, wherein:

i. the receptacle is attached to an anode end of the housing and extends into the housing;

the cathode plug is contained within the housing;

ii. the plug and receptacle are contained substantially entirely within the housing; and iii. the plug has a longitudinal axis parallel to the rotational axis.

11. The housing of claim 10 wherein the cable enters at an anode end of the housing, via the plug and receptacle, substantially parallel to the rotational axis.

12. The housing of claim 11 wherein the plug passes though the extended anode plane.

13. In a rotating anode x-ray tube housing of the type having a cathode and rotating anode, wherein the anode has a disk with both a rotational axis and an extended anode plane, the improvement comprising:

a. the sole to the housing being a cathode cable having an attached Federal Standard plug mounted within a Federal Standard receptacle, wherein:

i. the receptacle is attached to an anode end of the housing;

ii. the receptacle and plug are coaxial; and iii. the receptacle and plug are contained substantially entirely within the housing.

14. The housing of claim 13 wherein the sole cathode cable enters the housing at an anode end of the housing, via the plug and receptacle, substantially parallel to the rotational axis.

* * * * *